US006250233B1

(12) United States Patent
Luckring

(10) Patent No.: US 6,250,233 B1
(45) Date of Patent: Jun. 26, 2001

(54) SLIDABLE COVER ASSEMBLY FOR GONDOLA RAILROAD CAR

(75) Inventor: Allen K. Luckring, Brewster, OH (US)

(73) Assignee: Wheeling & Lake Erie Railway Company, Brewster, OH (US)

( * ) Notice: Subject to any disclaimer, the term of this patent is extended or adjusted under 35 U.S.C. 154(b) by 0 days.

(21) Appl. No.: 09/494,625

(22) Filed: Jan. 31, 2000

(51) Int. Cl.[7] ..... B61D 39/00

(52) U.S. Cl. ..... 105/377.01; 105/377.02; 105/377.03; 105/344.04; 105/377.05; 105/377.08; 105/377.09; 296/100; 296/137 B; 296/105; 296/100.16; 296/100.4

(58) Field of Search ..... 105/377.01, 377.02, 105/377.03, 377.04, 377.05, 377.08, 377.09, 377.1, 406.1; 296/100, 137 B, 105, 100.16, 100.4; 135/119

(56) References Cited

U.S. PATENT DOCUMENTS

| | | | | |
|---|---|---|---|---|
| 1,099,361 | * | 6/1914 | Hartland | 105/377.02 |
| 2,469,958 | * | 5/1949 | Fowler | 296/105 |
| 3,820,840 | * | 6/1974 | Forsberg | 296/100 |
| 3,942,830 | * | 3/1976 | Woodard | 296/105 |
| 4,248,475 | * | 2/1981 | Johnsen | 296/100 |
| 4,725,090 | | 2/1988 | Weaver . | |
| 4,801,171 | | 1/1989 | Weaver . | |
| 4,823,707 | * | 4/1989 | Salsbury et al. | 105/377 |
| 4,854,633 | * | 8/1989 | Kraft et al. | 296/104 |
| 4,858,984 | | 8/1989 | Weaver . | |
| 4,944,551 | | 7/1990 | Hardy, Jr. . | |
| 4,948,193 | | 8/1990 | Weaver . | |
| 4,995,663 | | 2/1991 | Weaver . | |
| 5,004,032 | | 4/1991 | Pedersen . | |
| 5,067,767 | | 11/1991 | Biancale . | |
| 5,080,423 | | 1/1992 | Merlot et al. . | |
| 5,152,575 | | 10/1992 | DeMonte et al. . | |
| 5,291,933 | | 3/1994 | Fussnegger et al. . | |
| 5,338,084 | * | 8/1994 | Wardell | 296/105 |
| 5,429,408 | | 7/1995 | Henning et al. . | |

* cited by examiner

*Primary Examiner*—S. Joseph Morano
*Assistant Examiner*—Frantz F. Jules
(74) *Attorney, Agent, or Firm*—Wood Phillips VanSanten Clark & Mortimer

(57) ABSTRACT

An extendable and retractable cover for use on gondola railroad cars, preferably provided as a kit for retrofitting existing cars, including elongated runners for attaching to the top of longitudinal walls of the gondola railroad cars, the runners including at east one slidable surface, for supporting and permitting transport over the surface of a plurality of tarp supports, which extend across the lateral opening between the sidewalls of the gondola railroad car. The supports are adapted and configured to slide over the runners while enclosing an edge of the runner so as to engage the runner and retain the vertical position and orientation of the supports during transposition across the surface of the runners. The tarp support members support a flexible sheet tarpaulin, impermeable to rain and the elements, above the tarp supports, and the tarp supports include a strip retaining member which, together with a bow member of the tarp supports, sandwich the tarpaulin between two rigid members so as to retain the tarp on the bows and the lateral ends of the tarp adjacent the top of sidewalls, so as to cover and protect the inside of the gondola car from the elements. Drive and retraction/extension mechanisms are used to permit manual operation of the arrangement to allow easy, efficient and speedy uncovering of a gondola car cover to permit loading and unloading of the gondola railroad car.

20 Claims, 7 Drawing Sheets

Fig. 13.
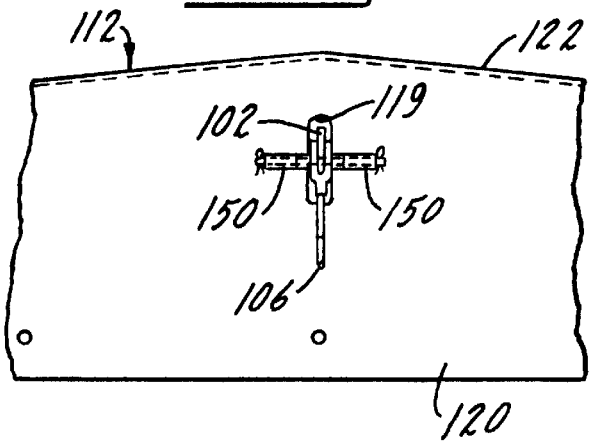
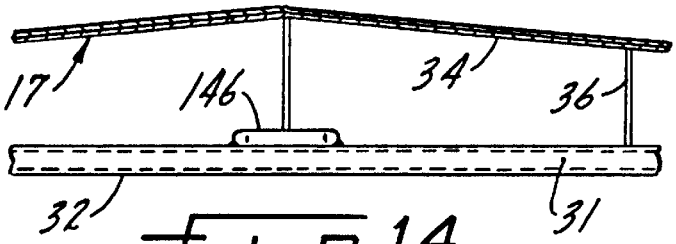
Fig. 14.
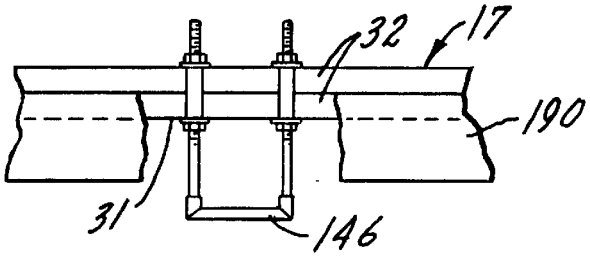
Fig. 15.
Fig. 16.
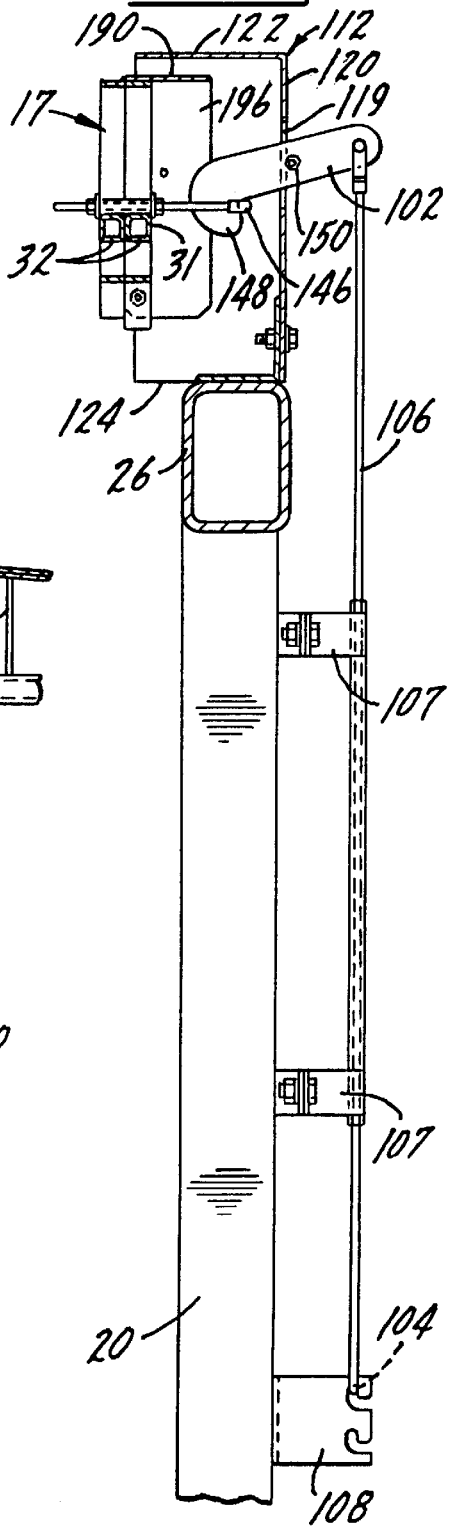

SLIDABLE COVER ASSEMBLY FOR GONDOLA RAILROAD CAR

BACKGROUND OF THE INVENTION

1. Field of the Invention

This invention relates generally to covers for gondola railroad cars, and more specifically to slidable covers which provide essentially a watertight enclosure for the contents of the gondola type railroad car.

2. Background Art

Gondola railroad cars having walls extending upwardly from a horizontal base of a railroad car truck body are utilized for carrying various goods, including finished steel goods. For long trips, during which good weather cannot be anticipated, it has been found advantageous to cover the top of the gondola car so that rain or snow does not come into contact with the goods being shipped. Contact with the elements causes deterioration of certain goods which may be carried in gondola railroad cars, to the detriment of the quality of the goods. For example, coils of rolled steel sheets, for which long distance transportation gondola railroad cars are preferred, contact with the elements such as snow or rain may cause deterioration of the steel sheet coils, and may render portions of the rolled steel sheet coils useless for their intended purpose.

Protecting the load in a gondola car is thus necessary for the transported goods to be delivered in a useful shape. One known method in the railroad industry to accomplish this goal is to provide solid covers, made of metal, which cover one-half of the gondola car. Two of these covers are capable of providing a fluid-tight cover of the well of the gondola car, so that the contents are protected from the elements. While such covers provide excellent protection from the elements, essentially sealing the gondola car's interior, the removal and replacement of the gondola car solid metal covers is a time, energy and resource consuming process. These types of covers are typically made from solid metal, and weigh upwards of several thousand pounds each. The covers normally require cranes to attach onto a looped handle structure on the top of the cover and to lift each cover so that it may be temporarily stored beside the gondola car. It is normally possible to use the same cranes with which the rolled steel coils are loaded and unloaded. However, several disadvantages result from utilizing such solid metal gondola car covers.

First, space in a loading and unloading zone must be allocated beside the gondola railroad car for temporary storage of the massive gondola car covers. Space is usually very limited in a loading zone, for example, for loading steel coils, and the covers must be usually stored for at least 4–8 hours in a zone where space may be desirable for other activities.

The amount of time and energy expended in removal and replacement of the gondola car covers can vary depending upon the equipment used and on the skill and experience of the operators. However, an average amount of time of at least 8 hours may be expended in the loading zone devoted only to the task of removing and replacing the solid covers. When factoring in the time expended to also load or unload the rolled steel coils from the gondola car, the operation may require one full day for loading, and a second full day in unloading the coils. Moreover, if a string of cars must stand for loading or unloading, space requirements do not permit loading or unloading more than two gondola cars per day, requiring up to a week for loading a full train.

Because of recent EPA regulations, the trucking industry has also found need to r cover truckloads quickly, efficiently and without large expenditures of resources. For example, tarps have long been known and used to cover trucks with walled sides, which trucks may be used to carry loose loads, such as gravel or fly ash. These tarps must be tied down along the lengths of the truck on each side, which operation requires two persons, one to tie down the tarp on each side of the truck. This procedure has been found to be inefficient, time consuming and requires the services of at least two people.

To overcome this inefficiency, the trucking supply industry has developed tarpaulin extension systems which can be manually operated by a single operator. For example, U.S. Pat. No. 4,858,984 describes and illustrates such a slidable truck cover assembly for use with open bed trucks. The slidable truck cover assembly utilizes a series of pulleys and a looped cable attached to a movable tarpaulin, sometimes referred to as a tarp. The tarp rests on and may be connected to a plurality of slats, which are movable along the top of the truck walls, so that the tarp has a base upon which to rest, and to keep the tarp from coming into contact with the load.

While sufficient for purposes of a regulation size truck, the assembly taught in U.S. Pat. No. 4,858,984 cannot be used in much larger railroad car constructions. It has been found that a railroad car using such a tarp when moving at high speed, or if there is a cross-wind, causes air flows under the tarp, lifting it up above the top wall of the railroad car and creating a tunnel effect for the wind to blow through and disturb the loose load. Additionally, the much greater longitudinal length of a railroad car requires a system for moving, extending and retracting the tarp which is not subject to excessive frictional forces, so that the tarp extension retraction operations may be efficiently completed by a single operator.

Retractable covers specific for use on railroad cars is illustrated and described in U.S. Pat. No. 5,026,109 to Merlot, Jr. The segmented cover system utilizes a plurality of solid cover sections which are nestable over each other and which are extended and retracted by means of a pulley and cable system, similar to that shown in aforementioned U.S. Pat. No. 4,858,984. However, the molded solid cover sections, including durable material compositions, such as polyurethane, are expensive to manufacture, assemble and maintain.

For these reasons, what is needed in the railroad industry is an inexpensive, efficient railroad car cover assembly which can be utilized by a single operator on the ground, and which can deploy or retract a cover over the full length of a railroad car in a minimum amount of time, on the order of five minutes, rather than hours.

SUMMARY OF THE INVENTION

Accordingly, what is described and claimed herein is a slidable gondola railroad car cover for covering the open top of a gondola railroad car, the gondola railroad car having at least two sidewalls and comprising at least one runner extending along the top of at least one of the sidewalls of the gondola railroad car, each runner further including a smooth slidable surface extending along and essentially parallel to an associated top of the gondola railroad car sidewalls; a flexible sheet cover being wide enough to extend laterally for a dimension at least as wide as the area between the sidewalls of the gondola railroad car; and a plurality of tarp cover supports, each cover support comprising a central bow section, and two lateral end sections disposed at each end of the bow section, the lateral end sections each including a downwardly extending slat extension and a cantilevered runner retainer extending inwardly from the slat extension and disposed so as to wrap around said runner edge, and further comprising an attachment member to attach the flexible sheet cover to the top portion of the bow without extending to the slat extension.

In a preferred embodiment, the runners comprise I-beams which are covered at least on the upper sliding surface with an elongated sleeve of hand-moldable elastomeric material that minimizes friction when the bows and cover are transported over the runner sliding upper surface. The sleeve material is preferably polyurethane.

BRIEF DESCRIPTION OF THE DRAWING FIGURES

FIG. 13 illustrates in detail the lead tarp support locking mechanism shown at the top of the gondola car side view of FIG. 2.

FIG. 14 shows a detail in partial elevational view of an inventive tarp support including the locking mechanism.

FIG. 15 is a top break away view of the lead tarp support shown in FIG. 14.

FIG. 16 illustrates in partial cross-section, a side view of the inventive locking subassembly, taken approximately along the line 16—16 of FIG. 2.

DETAILED DESCRIPTION OF THE PREFERRED EMBODIMENT

Figures 1, 5:
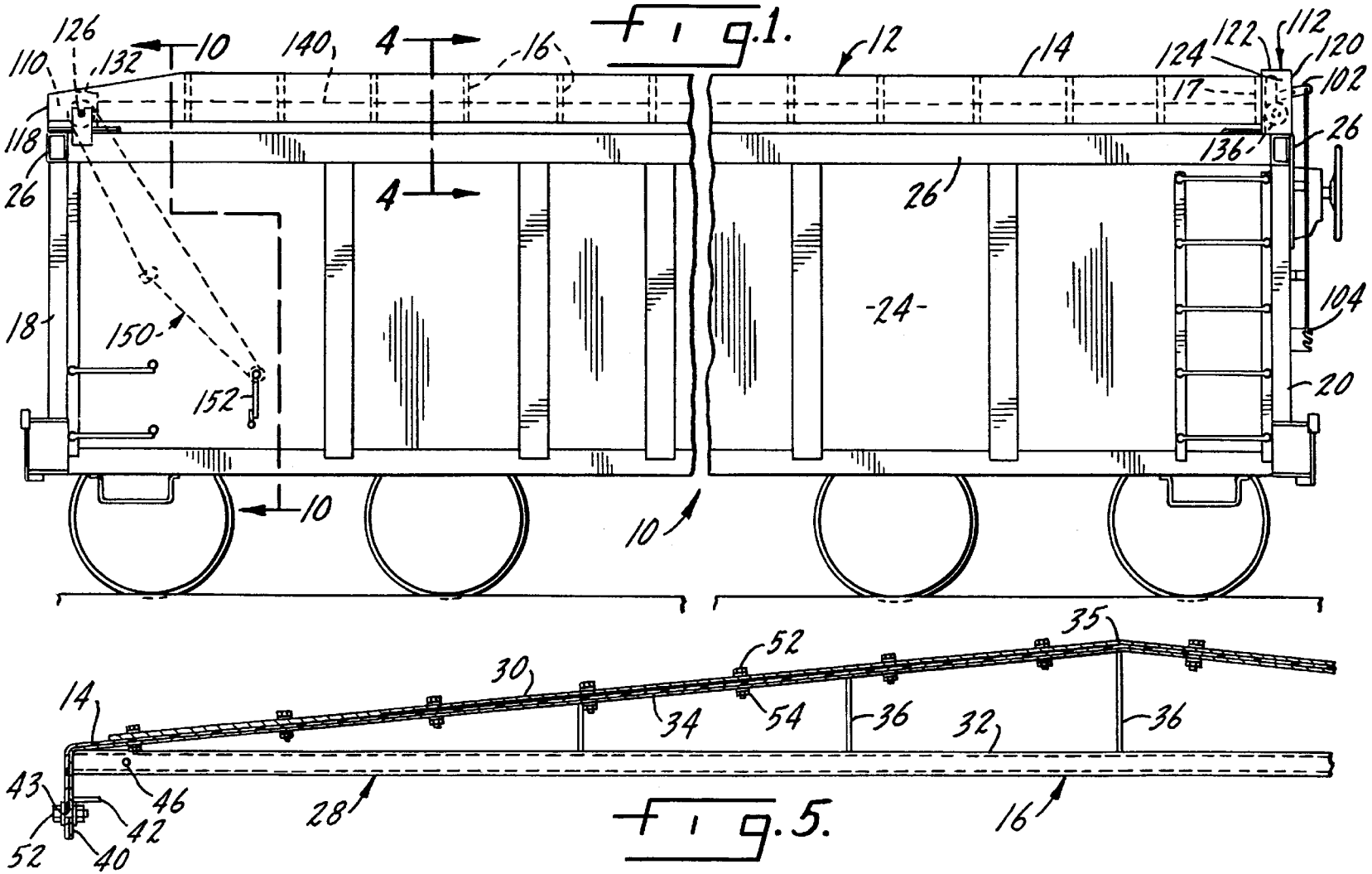
FIG. 1 is an elevational view with the middle portion omitted of a gondola railroad car utilizing the present invention.
FIG. 5 is an side view illustrating the preferred middle embodiment tarp support according to the present invention.
Figure 2:
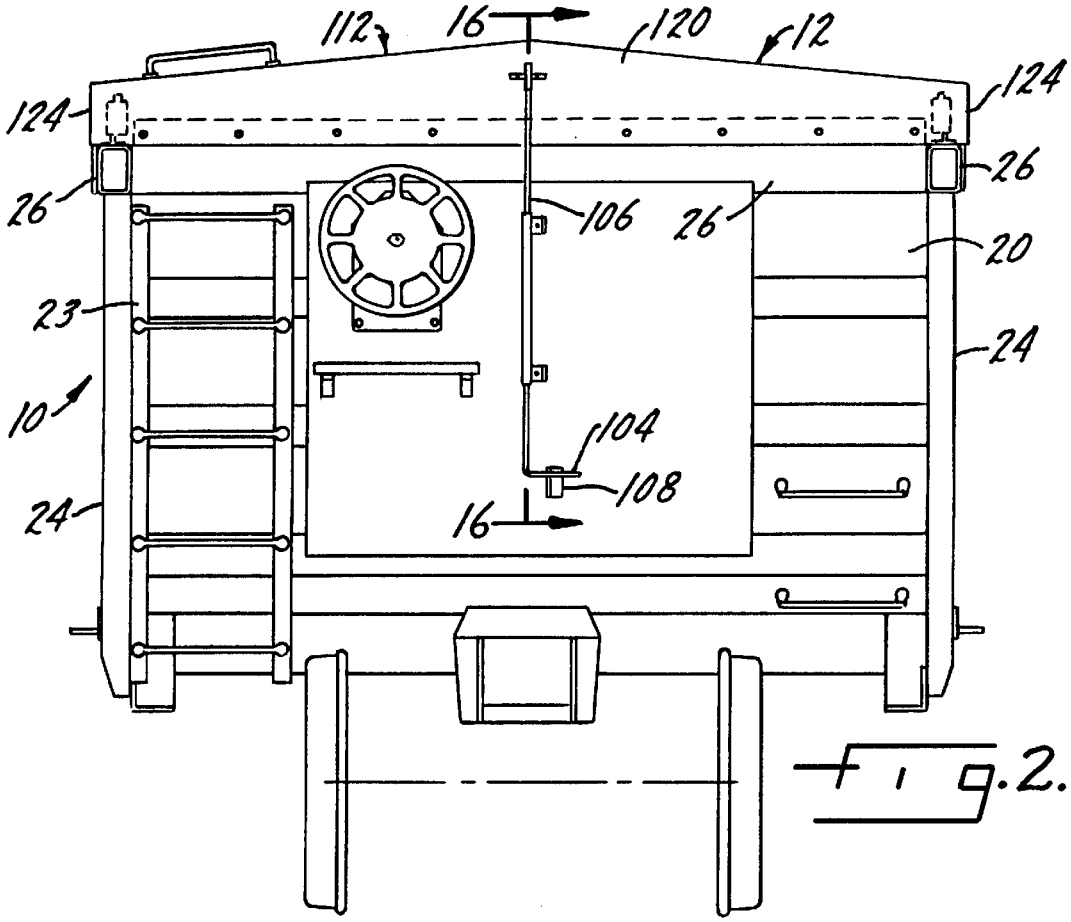
FIG. 2 is a right end view of the gondola railroad car of FIG. 1.

A railroad car, such as the gondola railroad car 10, illustrated in FIGS. 1 and 2, includes a retractable cover arrangement 12 according to the present invention. The invention comprises four basic sub-systems, each of which will be described in greater detail below. These sub-systems are: (a) the tarpaulin, sometimes referred to herein as the tarp, including the tarp supports; (b) the tarp extension/retraction mechanism including the slidable runners along which the tarp and tarp supports slide to provide a cover for the gondola truck bed, and including a cable and pulley system for extending and retracting the tarps, (c) the extension/retraction drive mechanism, including a crank and chain connected to the pulleys, and (d) a locking mechanism for locking the tarp and supports when the tarp has been fully extended so as to enclose the gondola railroad car contents after loading.

Referring now to FIGS. 1 and 2, the gondola car 10 is covered by a retractable and extendable tarpaulin cover arrangement 12 which includes a tarpaulin cover 14. The tarp cover 14 is shown extended in FIG. 1 and comprises essentially a fabric or film material which is supported by a plurality of tarp supports 16, which will be discussed in greater detail below. The tarp extends from the top of a first longitudinal end wall 18 of the gondola railroad car 10 to a second longitudinal end wall 20, essentially enclosing the top of the open gondola railroad car 10 and containing the volume defined by the truck bed 22 and between the upstanding end walls 18, 20 and two longitudinally extending lateral sidewalls 24 of the gondola railroad car 10. Ladder 23 disposed on end wall 20 provides access to the top and inside the container of the gondola railroad car 10.

In accordance with the teachings of the present invention, the tarp cover arrangement 12 is disposed along the top edge of each of the walls 18, 20, 24, thereby making the height of the railroad car 10 somewhat higher than a gondola railroad car not using the arrangement 12. It is important to understand, however, that the side-to-side dimensions of the railroad car do not substantially increase, since it is important that the dimensions remain within the parameters established by railroad regulating authorities. Height dimensions are not restricted to a major extent, and the arrangement 12 does not add significantly to the height of the railroad car 10.

The restrictions for lateral dimensions of railroad cars are much more stringent due to clearance requirements of railroad cars when two trains are passing on parallel tracks. As will be described in more detail below, all elements of the invention must meet the side-to-side dimensional restrictions. The crank handle, used to drive the extension/retraction mechanism of the invention, must especially not extend beyond the lateral side walls 24 of the railroad car 10, because it must not create a danger to railroad employees or others who may be standing next to a moving train. Likewise, interference of an extending crank with a railroad worker's clothing as he or she climbs on the ladder 23 at the end of the railroad car 10 must also be avoided.

Figure 4:
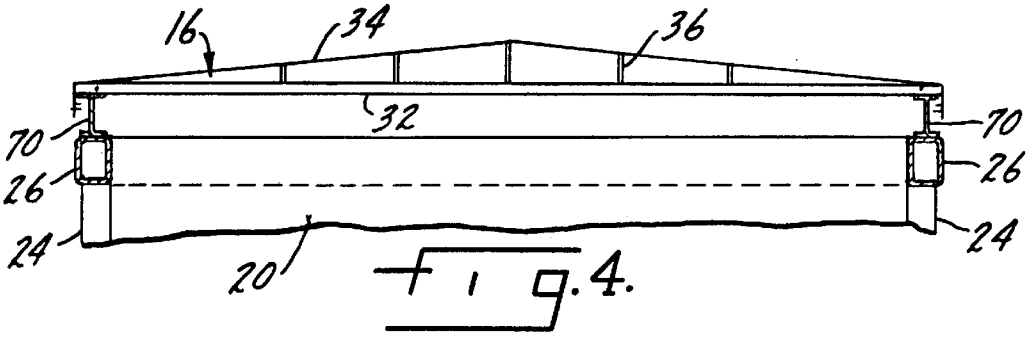
FIG. 4 is a cut-away, cross-sectional view of the top section of a gondola car according to the present invention, taken approximately along the line 4—4 of FIG. 1.
Figure 8:
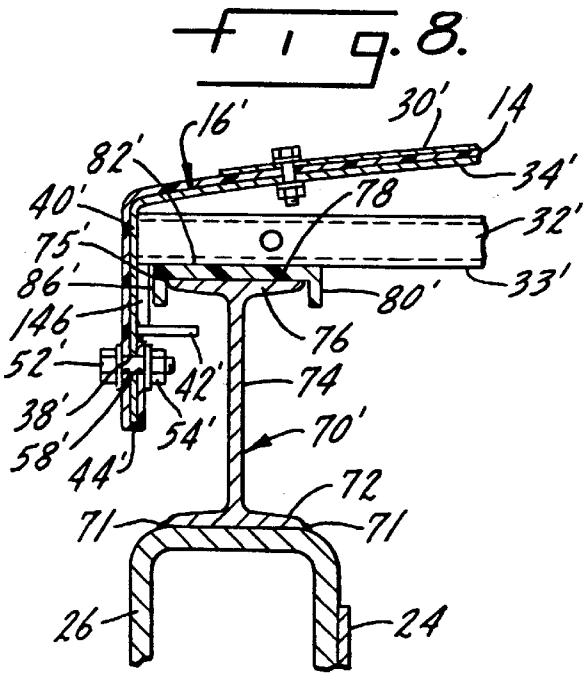
FIG. 8 is a detailed cross-sectional view of an alternative embodiment of an inventive tarp support showing in detail an end thereof.
Figure 6:
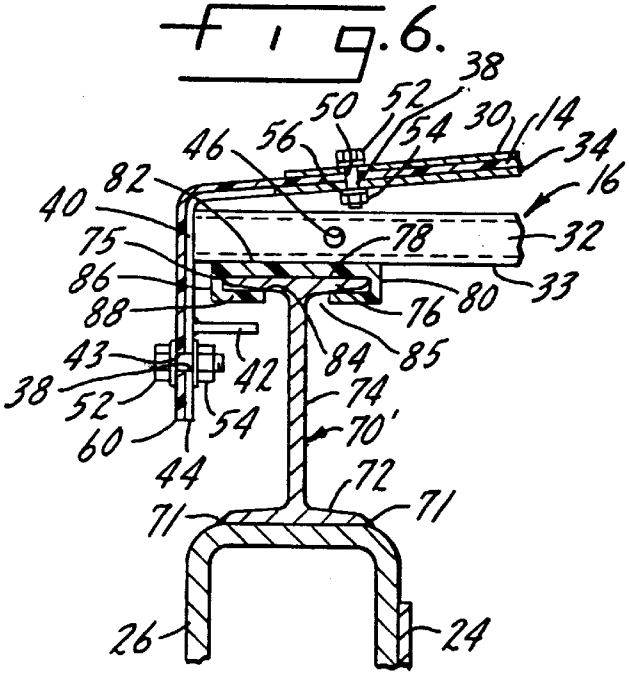
FIG. 6 shows a tarp support in section as shown in FIG. 5, illustrating a detail of a lateral end thereof.

Referring now to FIGS. 1, 4, 6 and 8, the details of the tarp extension/retraction runners 70, 70' are described. FIG. 4 illustrates in a cross-sectional detailed view the cross-section being taken approximately along the line 4—4 of FIG. 1, and FIGS. 6 and 8 illustrate in cross-sectional, greater detail, alternative embodiments of the runner 70, 70' and tarp support 16. Illustrated in FIGS. 6 and 8 are cross-sectional views of the tarp cover 14, which may comprise a vinyl or sheet polyurethane material or another material which is both flexible and essentially impervious to water. The tarp 14 rests on tarp supports 16 (shown in FIG. 4 and dotted in FIG. 1).

The tarp supports 16 (FIG. 4) are preferably metal or other hardened resilient material which is capable of maintaining its shape despite being subjected to the expected vagaries of weather, including severe weather and the knocking about of railroad equipment during normal railroad operations.

Although hardened molded plastics or composite materials may also be utilized for manufacture of the tarp supports 16, metal is the preferred material because it optimizes the trade-off between cost and durability.

A plurality of tarp supports 16 (FIGS. 1 and 4) are disposed for mounting of the tarp cover 14 (FIG. 1). The tarp supports 16 operate in conjunction with the rest of the tarp arrangement 12 to keep the tarp cover 14 as close as possible between a tube rail 26 extending along the top edges of walls 18, 20 and 24, in a taut condition when the tarp cover 14 is extended, and bunched up, similar to an accordion, when the tarp cover 14 is in a retracted condition. The tarp supports 16 include a lead tarp support 17 (shown in detail in FIGS. 11 and 12), which has several unique features, and will be described in greater detail below with reference to FIGS. 11 and 12. The tarp supports 16, 17 provide a movable, slidable surface for supporting the tarp cover 14, and for extending and retracting the tarp cover 14, as desired.

Each tarp support 16 (FIGS. 4 and 5) comprises a frame member 28 and a tarp strip 30, both preferably made of a non-oxidizable metal, such as stainless steel or aluminum. The tarp support frame member 28 comprises a crossbar 32 which may be a one-inch square hollow shaft that acts as the base of the support frame member 28. Attached to the crossbar 32 is a mounting bow 34 which may be connected at its lateral ends to the lateral ends of the crossbar 32 by welding or other appropriate conventional means. The mounting bow 34 preferably comprises a metallic sheet metal band which is convexly bent above the crossbar 32 to provide a bow 34, as shown.

Figure 7:
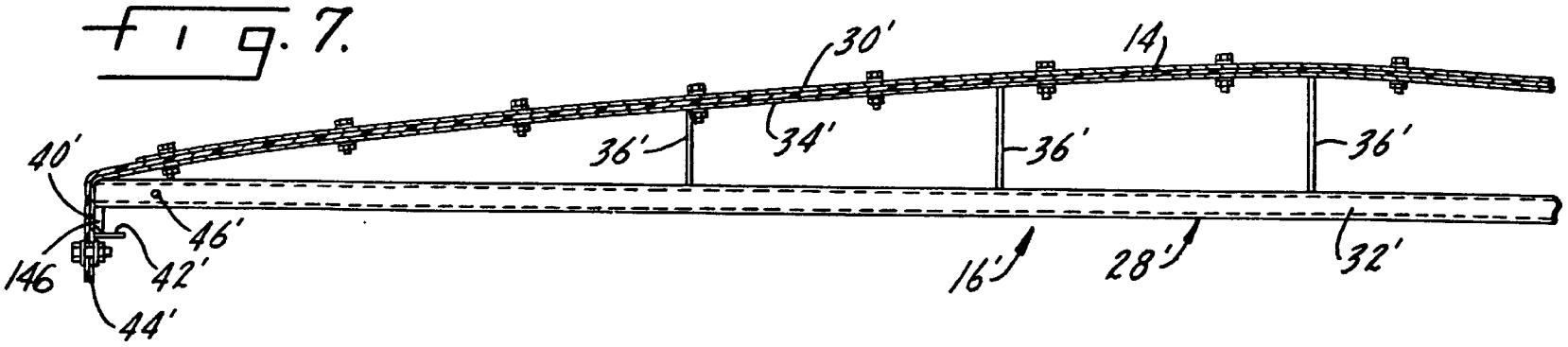
FIG. 7 shows in an elevational view an alternative embodiment of an inventive tarp support.

The bows 34 shown in FIG. 5 are the preferred configurations. The bow 34 and strip 30 are bent at the central portion, as shown. An alternative configuration is illustrated in FIG. 7, where the bow 34' is bent to form an arc, and the strip 30' has a corresponding shape, which with the tarp cover 14 form a vaulted tarp cover arrangement.

Referring again to the preferred configuration of FIGS. 4, 5 and 6, the band of bow 34 includes a plurality of through holes 38 which provide means for connection of the tarp cover 14 onto the bow 34 of each tarp support 16. The through holes 38 are separated by a predetermined separation, such that they line up with corresponding holes in the tarp cover 14, which may be reinforced to inhibit tearing of the tarp material.

Several metal slats 36 provide vertical support between the crossbar 32 and the bow 34 to maintain the shape of the bow in the face of compressive forces. The slats 36 may be welded at their ends to the crossbar 32 and to the bow 34. The angle or slope of the end sections of the bow 34 need not be great, but should be large enough to avoid collection of water on the tarp cover 14 when the tarp arrangement 12 is in the extended position.

The tarp support frame 28 further comprises two downwardly extending slat extensions 40, which may be integral with the bow 34, as shown, or which maybe welded onto the ends of crossbar 32 to extend below the crossbar, as will be described below. The shape and dimensions of the slat extensions 40 may be similar to that of slats 36, but the orientation should be perpendicular to the crossbar 32 and when installed, the slats 36 extend downwardly away from the bow 34 in order to properly interact with the other elements of the tarp arrangement 12. Through holes 43 (FIG. 6) are provided in slat extensions 40 for the attachment of the lateral ends of the tarp 14, as described below.

Projecting laterally from the slat extensions 40 are retainer members 42, which extend inwardly. Retainer members 42 are attached, preferably welded, onto slat extensions 40 at a point approximately 1–2 inches from the end or lowermost point 44 of slat extensions 40. The inward projection of retainer members should not extend too far inwardly, so that it does not interfere with the ability of the tarp support 16 to slide along the runners, as will be described. A predetermined gap width between the retainer members 42 and the crossbar 32 is desirable.

The tarp support 16 and the mounting bow 34 provide a movable supporting surface upon which the tarp cover 14 may be supported from below. Once the holes on the tarp cover 14 are lined up over through holes 38, a tarp retainer strip 30, having a corresponding plurality of through holes 50 (FIG. 6), is placed over the tarp cover 14. The retainer strip 30 is shaped and dimensioned to track and follow the contour of the bow 34, which includes matching of the positions of the plural through holes 38 of the bow 34. As is shown in FIGS. 1 and 4, and as is applicable in the alternative embodiment of the tarp supports 16' (FIG. 8), described below, the lateral extent of the strip 30 does not extend completely to the junction of the slat extension 40 and the bow 32, but stops short thereof. It has been determined that the slat extensions 40 and a connecting member, as shown, are sufficient for retaining the tarp cover 14 attached to the lateral portions of the frame 28, and for retaining the tarp cover edges below the top of the sidewalls of the gondola railroad car 10.

When the through holes 38, 50 are lined up with the corresponding reinforced holes of tarp cover 14, connection or attachment members are inserted through the holes and fastened to the associated members on either side of the tarp cover 14. While in FIGS. 4, 5, 6 and 8, the attachment means comprise a bolt 52 and nut 54 fastener, and includes one or more washers 56 to retain the fasteners and tarp cover 14 in place, any type of appropriate fastener is contemplated as being capable of being used for this purpose. For example, semi-permanent hardened plastics snaps, "conoe" clip fasteners, drive rivets, quarter turn fasteners or retaining rings may be utilized to reduce costs of manufacture and/or assembly, and which are contemplated as alternative fastener members.

Tarp cover 14 has a lateral dimension significantly wider than the length of the crossbar 32, so that it may extend downwardly over the slat extensions 40. The connection members, such as a nut/bolt combination 52, 54, retain the longitudinal edge 60 of the tarp cover 14 connected to frame 28. The longitudinal edge 60 of tarp 14 is attached to the downwardly extending slat extensions 40, by insertion of a fastener combination through the through hole 43, as shown. To permit correct functioning of the tarp supports 16, 17, it is important that through hole 43 and connectors, such as nut/bolt combinations 52, 54, are disposed vertically below retainer members 42, so as not to impede the slidability of the frame members 28 over the runner 70, as described below.

The attachments of plural tarp supports 16 to the tarp cover 14 are spaced apart along the longitudinal dimension of the tarp cover 14, with a predetermined spacing between adjacent tarp support members 16 of about 2 feet when the tarp cover 14 is in a fully extended condition. Utilizing such predetermined spacing requires use of about 25–30 tarp supports 16. Optimally, 28 tarp supports accommodate complete coverage of a standard inside dimension of a gondola railroad car 10.

An alternative configuration of a tarp support 16' is shown in FIGS. 7 and 8. The support 16' is essentially the same as support 16 (FIGS. 4 and 5), including a cross bar 32', metal slats 36' and slat extensions 40'. The major difference between support 16' and support 16 is in the shape of mounting bow 34' (FIG. 7).

The preferred embodiment shown in FIG. 5 includes a mounting bow 34 having two essentially straight bow portions which are upwardly sloping from the slat extensions 40 toward a mid point 35, where they are joined to each other. More appropriately, and as shown in FIG. 5, the two bow portions may be formed by bending a strip of metal bow material at the mid point 35 so as to form a shallow angle of the two lateral ends. Bending the metal strip almost at a right angle at the appropriate lateral edge position of the bow 34 be used to form the slat extensions 40. Again, to ensure that the connection of the tarp lateral edges to the frame of support 16 does not interfere with the ability of the tarp supports 16 to slide smoothly over the runner 70, the holes 43 for the connections must be disposed below the retainer members 42, as shown.

Referring now to FIGS. 7 and 8, a detail cross-section of the lateral end of the alternative embodiment tarp support 16' is shown, and in FIG. 8 is shown installed over an alternative embodiment slidable runner 70'. Runner 70' also differs from runner 70 (FIG. 6) in that it does not have inwardly extending edges on the underside for completing a sleeve, as will be explained below. However, the essential discussion of the runner 70 and associated elements in FIGS. 4, 5 and 6 is equally applicable to the other embodiments of tarp supports 16 and 16' shown in FIGS. 7 and 8.

Runners 70 or 70' provide two important features for the tarp supports 16 or 16'. First, the runner 70 provides a vertical support surface for the crossbar 32 or 32' of the tarp supports 16 or 16'. For the purposes of this description, the following discussion of the interaction of tarp supports 16 with runner 70 should be considered applicable to the same interconnection with tarp support 16' and runner 70' except where specific differences are noted. The other feature applicable to the preferred embodiment is an outwardly extending edge, such as edge 75 (FIG. 6), which is used to retain upright the tarp support 16, on or immediately adjacent the lateral edge 75 of runner 70, and will be explained in greater detail below.

The runner 70 is shown mounted and attached to the top edge of a gondola railroad car wall, such as sidewalls 24 (FIG. 1), at the top of which a rectangular tube rail 26 is attached as a crown. The runner 70 may be attached to the tube rail 26 by, for example, welding to the top of gondola railroad car sidewalls 24, as shown. Two welding beads 71 are sufficient to attach the runner 70 onto the tube rail 26.

The runner 70 may comprise, preferably, an I-beam having a depth of about four inches, and having a bottom flange 72 welded to the top of the tube rail 26 by a bead 71 on either or both lateral edges of bottom flange 72. Runners 70 essentially extend from the first end wall 18 to the second end wall 20 for the whole length of the gondola car 10 at either sidewall 24, and preferably comprise a unitary member. The web 74 of each I-beam runner 70 extends vertically to an upper flange 76 disposed above the tube rail 26 so that the upwardly facing surface 78 of the upper flange 76 lengthens the height of the sidewalls 24 about four inches from the top of the standard tube rail 26.

Upper flange 76, including upper surface 78, is covered by a preferably unitary longitudinal sleeve 80 (80', FIG. 8) which provides a smooth sliding surface 82 to permit the easy slidability of the tarp supports 16 over the runner 70. Preferably, the sleeve 80 comprises a unitary thermoplastic or resin material, such as polyurethane, which is shaped and dimensioned to include on the underside a bight 84. The bight 84 provides a channel so as to encompass and surround the upper flange 76 of I-beam support runner 70, as shown in cross-section in FIG. 6. Ideally, the sleeve 80 provides an enclosure within bight 84 and includes an opening 85 for permitting the web 74 to extend downwardly from sleeve 80 through the opening 85 in the bight 84. A sleeve which essentially encloses the upper flange 76 is desirable in retaining the sleeve 80 in position, since the lower surface 88 of the sleeve 80 inhibits upward movement of the sleeve, even if it is jostled by the retainer member 42 during normal or extreme operational conditions.

The crossbar 32 of the embodiment of tarp support 16 shown in FIG. 5 and includes a downwardly facing, lower surface 33. It is desirable for sleeve 80 to provide a sliding surface 82 for the crossbar 32 or any of the alternative embodiments described below. The embodiment shown in FIGS. 5 and 6 also includes two additional sliding surfaces, a second vertical sliding surface 86 and a downwardly facing, third sliding surface 88. It should be noted that the discussion regarding the runner 70 and sleeve 80, including sliding surface 82, is also applicable to the other tarp support embodiments illustrated and described herein, even though the discussion regarding the undersurface 88 may not be applicable to the alternative embodiment of sleeve 80'.

The embodiment of tarp support 16' shown in FIGS. 7 and 8 includes a crossbar 32' having a downwardly facing, lower surface 33'. It is desirable for sleeve 80' to provide a sliding surface 82' for the crossbar 32' of this alternative embodiment, and to provide at least one additional sliding surface, a second vertical sliding surface 86'. It should be noted that although the preferred embodiment of the sleeve 80 shown in FIG. 5 includes a downwardly facing surface, such a surface may not be absolutely necessary, since the weight of the tarp supports 16' is capable to retain the sleeve 80' (FIG. 8) in its position over the upper flange 76.

Referring now to the preferred embodiment to the tarp support 16 is shown in FIG. 6, the sliding surfaces 82, 86 and 88 face outwardly from upper flange 76, and upper surface 82 provides support to the surface 33 of crossbar 32. The vertical sliding surface 86 is also necessary to provide a sliding surface for the slat extension 40 to permit sliding of the tarp support 16 across the I-beam runner 70 in the event that the frame member 28 of tarp support 16 becomes slightly misaligned across the opening of the gondola railroad car 10 which is between sidewalls 24.

Misalignment of the frame 28 causes the crossbar 32 of support 16 to become skewed relative to the sidewalls 24 and to not present a perpendicular orientation of crossbar 32 relative to the sidewalls 24. Skewing of the frame 28 causes the horizontal clearance between the slat extensions 40 and the runner vertical surfaces 86 to be reduced and thus to result in frictional contact between the slat extensions 40 and the vertical surface 86 of the sleeve 80.

To provide more readily available sliding surfaces between these two elements in the event of skewing of the tarp support 16, the embodiment of frame member 28' shown in FIGS. 7 and 8 includes a rounded guide 146. Even when the frame member 28' becomes slightly skewed, the rounded guide 146 always presents a near parallel face to the opposed, vertical sliding surface 86'. Preferably, the rounded guide 146 extends from the retainer member 42' to the crossbar 32' on each side of the tarp support embodiment 16', as shown in FIG. 8. The curvature on the guides 146 may be slight, on the order of a radius having about a two to three inch locus, so that any object which comes into contact with the guide 146 provides a smooth sliding surface which is close to parallel to the surface of the object (surface 86') striking the guide 146 regardless of the angle of incidence. For a smooth flat plane, such as the surface 86', the frictional contact is minimized by the smooth, slick surface of the polyurethane elastomeric material comprising sleeve 80'.

Referring again to FIG. 6, sliding surface 82 of the sleeve 80 provides a sliding surface for the crossbar 32. In the event that frame member 28 is displaced from the normal vertically upwards orientation, the third sliding, surface or undersurface 88 provides a friction reduced surface to the retainer member 42 to slide against. Thus, the tarp supports 16 are permitted to glide over the runners 70 without being obstructed by laterally extending obstacles, which would otherwise present excessive friction to the movement of tarp supports 16.

Moreover, including the curved, rounded surfaces of guides 146 in either embodiment of tarp supports 16, 16' permits the tarp 14 to pull a tarp support 16, 16' which has become skewed back into perpendicular alignment. Freedom of the opposed surfaces to slide past each other irrespective of the degree of misalignment and the lack of sharp edges or other lateral obstructions that could catch on the opposite sliding surface 86 of the sleeve 80 permit easy transposition of the tarp support 16, 16' over the sleeve or 80 or 80'. As the tarp material 14 becomes stretched and taut from the pulling experienced by the immediately preceding tarp support 16, 16', the length of the tarp material at the two lateral edges of the tarp cover 14 being identical results in the coordinated deployment of the succeeding tarp support 16, 16' by each lateral edge of the frame 28, 28' being pulled forward in essentially a parallel direction to the sidewalls 24.

The friction reduction feature provided by the smooth sliding surfaces 82, 86 and 88 of polyurethane sleeve 80 and surfaces 82' and 86' of sleeve 80' is a necessity for a large tarp cover 14 when used on gondola railroad cars 10. The longitudinal dimension of a standard gondola railroad car is about 54 feet (inside dimension), and is much longer than that of an over the road truck. In order to operate the tarp cover assembly 12 under extreme conditions and to permit extension and retraction of the tarp 14 by a drive mechanism including a handcrank, as described below, the elongated container opening of a gondola car 10 requires additional tarp supports, closely spaced over the gondola car opening. The larger area covered by the tarp 14, which for a gondola car generally is also much wider than that of a truck, greatly increases the amount, and the weight, of the material being deployed over the runners 70. Thus, frictional forces impeding extension or retraction of the tarp cover 14 must be minimized in order for efficient operation by trained personnel.

Each of the embodiments of tarp supports 16, 16' includes a plurality of connection members, such as nut/bolt combinations 52/54 (FIG. 3), to hold the lateral ends of the tarp cover 14 at the lower edges of the slat extensions 40. Additionally, as can be seen in the detail view of the alternative embodiment in FIG. 8, the tarp 14 may, at its lateral edge, be folded over the lower most point 44' to double up on the connection of the bolt 52' and nut 54' combination. Of course, such a configuration would require a double set of holes 58', disposed at the lateral edges of the tarp cover 14 for insertion of bolt 52' through both sets of holes 58' and through an aperture 38' in the extension slat end 40'.

Gondola railroad cars must be capable of withstanding extreme and severe weather conditions, including high winds, which are capable of lifting conventional tarp covers, as presently used with open bed, over-the-road trucks, completely off of the runner surfaces. To overcome such extreme wind conditions and possible undesirable exposure of the gondola car container to the elements, the tarp supports 16 or 16' are manufactured from a sturdy, heavy material, such as stainless steel. Thus, the weight of the crossbar 32 and other frame materials serves to retain the lateral ends of the tarp cover 14 as close as possible to the gondola railroad car sidewalls 24. The cantilevered runner edge 75, operating in conjunction with the runner sleeve 80 and the space in the frame 28 or 28' defined by the crossbar 32 or 32', the extension slat 40 or 40' and the retainer members 42 or 42', permits the tarp supports to slide easily along the runners 70, while simultaneously firmly retaining the tarp support 16 or 16' and the tarp cover 14 over the opening between the sidewalls 24 of the gondola railroad car 10.

Another important feature which is provided by the inventive runner and tarp support configuration of the present invention is best illustrated in FIG. 6. The dimensions between the retainer members 42 and the lower surface 33 of crossbar 32 provide just enough clearance to cradle the runner edge 75 within the space of frame 28 which surrounds the edge 75. If a sleeve is disposed over the runner edge 75, such as sleeve 80 disposed over I-beam flange 76, the distance between the lower surface 33 and the retainer member 42 is slightly larger than the thickness dimension between sleeve upper surface 82 and the lower, downwardly facing sliding surface 88.

However, that clearance is preferably not so great as to allow the orientation of the frame 28 of tarp support 16 to deviate excessively from the vertical. That is, the tarp cover 14 comprises a flexible fabric material, such as a plastic or polyurethane tarpaulin, which by itself support the "floating" tarp supports 16 so as to retain them in a vertical position. The tarp support 16, including the retainer 42 which cradles the runner edge 75, is "free-floating" over the runner 70. Thus, a mechanism is required to maintain the vertical orientation of each frame member whether 28 28'; otherwise, the tarp supports 16 are liable to tip or lean over from their normal vertically aligned position.

Side-to-side leaning of the frame 28 is not desirable because it tends to increase the difficulty in transposing the tarp supports over the upper surface of the runner 70. Tipping of the frame 28 or 28' causes the edge of the crossbar 32 or 32' to engage the sliding surface 82 or 82', thus increasing stationary friction. The tight clearance and longitudinal width of the crossbar 32 and of the retention member 42 do not permit a great degree of angular deviation from the vertical of the frame 28. When the frame 28 begins to tip, any angular deviation that begins to develop, causes the retainer member 42 to rise up to meet the downwardly facing surface 88, arresting any continued angular deviation from the vertical. As the tarp 14 continues pulling the tarp support 16, 16', the tendency is to revert the frame 28, 28' to a vertical position.

Another feature of the present invention further causes the tarp supports 16, 16' to retain their vertical and perpendicular orientation to the sidewalls 24 of gondola car 10. That is, each crossbar 32 or 32' has disposed, at a position close to the lateral ends thereof, apertures 46 (FIGS. 5 and 6) or 46' (FIGS. 7 and 8). The apertures 46 or 46' extend throughout the crossbars 32 or 32', and have an appropriate size to permit extension therethrough of a cable or wire, as will be further explained below.

Figure 11:
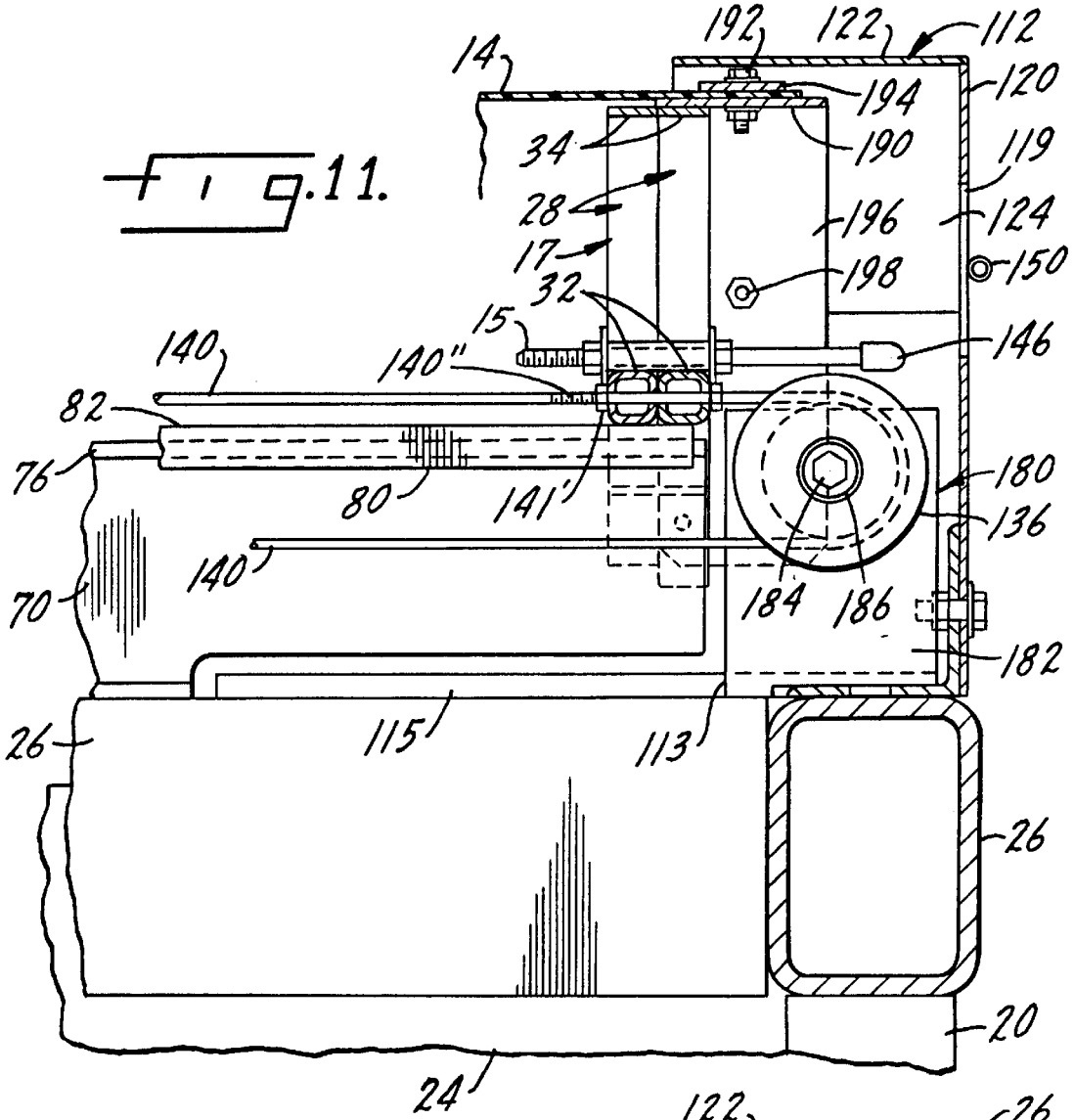
FIG. 11 is a detail elevational view of the pulley and cable attachment to the inventive runner arrangement.
Figure 12:
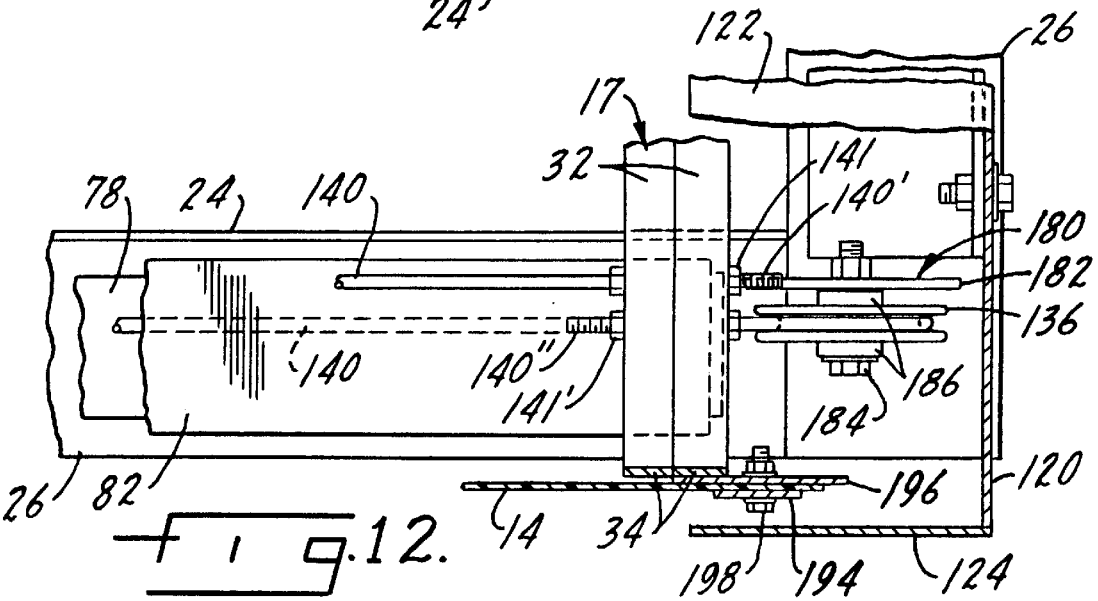
FIG. 12 is a detailed top view of the pulley and cable attachment shown in FIG. 11.

It has also been observed that the lead or end tarp support is especially susceptible to angular and/or lateral deviation from the perpendicular. The lead tarp support, best illustrated at 17 in FIGS. 11 and 12, is disposed and attached to the longitudinal end of the tarp cover 14, and has preferably twice the width and weighs twice as much as the other tarp supports 16. The lead tarp support 17 may comprise two tarp supports 16 that have been attached to each other by appropriate means, such as a fastener 15 (FIG. 11). A means for connection to the longitudinal edge of the tarp cover 14 is appropriate, for example by connecting the tarp 14 to one or both of the frame members 28 comprising lead tarp support 17. The lead support 17, of course, is the tarp support member which is adjacent the longitudinal end wall 20 of the gondola railroad car 10 when the tarp cover 14 is in a completely extended condition, as shown in FIG. 11.

Referring now to FIGS. 11, 12 and 16, a cross-section of the gondola car end wall 20 is shown, including a side view of a lead tarp support 17. First cable end 140', having appropriate threads, is inserted through apertures 46" in the crossbars 32 or 32' of the lead tarp support 17. The aperture has a corresponding size, for example ⅜", which permits insertion of the cable end 140' and a nut 141 is screwed onto the threads protruding from the aperture 46 in the crossbar 32. The cable is then looped around the pulley 126 (shown in hidden lines in FIG. 1) and is then looped again under the upper flange 76 and sleeve 80 of the runner 70 and is extended to the pulley 136 (FIG. 11), around which it is also looped, as shown.

Following the loop around pulley 136, the second threaded end 140" of the cable 40 is inserted into a second set of apertures 46 in the crossbars 32 for receiving the econd end 140". Apertures 46 are preferably disposed adjacent the apertures 46", in which the first cable end 140' is received. Two sets of two apertures 46, 46" each are disposed, one set at each lateral end of the lead tarp support 17, and each cable end 140', 140" attaches to each set of two apertures 46, 46". Thus, any force on the lead tarp support 17 from end 140' of the cable 140 is not opposed by resistance from the other end 140" of cable 140, since the loop of cable 140 rotates in unison. When the pulleys 126, 136 are rotated, one cable end 140', 140" is pulled, and the other cable end 140', 140" offers no resistance since the cable provides an endless loop and continuous payout of cable 140.

The threaded second cable loop end 140" is also attached to the lead tarp support 17 by means of a second nut 141' (visible in FIG. 12). Optionally, a spring mechanism (not shown) at either end of the cable, 140' or 140" may be inserted between the nut 141 and the crossbar 32, so as to maintain the loop of cable 140 at a desirable tension, in order that sufficient frictional force between the cable 140 indures both pulleys 126, 136 to turn and rotate simultaneously.

Referring again to FIG. 1, the tarp cover arrangement 12 includes an extension and retraction subassembly, which is disposed adjacent a tarp cover housing 110, 112. Each endwall 18, 20 of the gondola railroad car 10 has disposed at the top a cover housing, preferably attached to the tubular rail 26 of each endwall 18, 20. Tarp cover housing 110, 112 is mounted to and atop gondola car endwall 18, 20.

Figure 3:
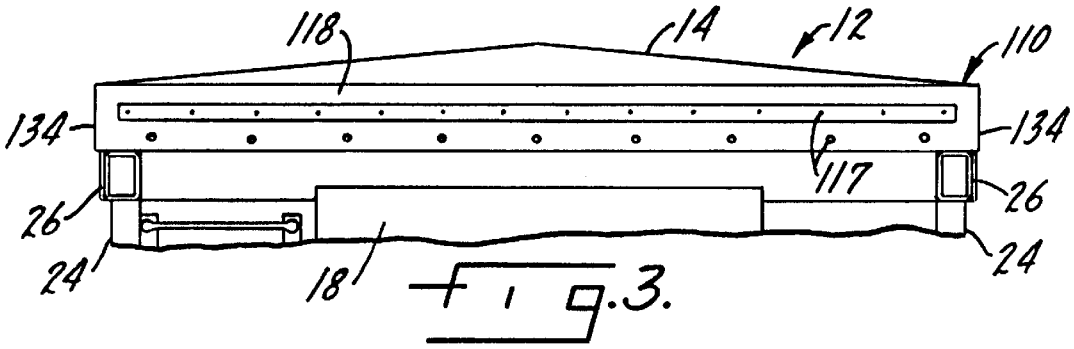
FIG. 3 is a partial elevational view of the top section side of the gondola railroad car opposite to the side shown in FIG. 2

Referring now to FIGS. 1 and 3, first endwall 18 includes the first housing 110. The first housing 110 includes a housing endwall 118, a bow cover plate 132, and two sidewall members 134, one each attached on the tube rail 26 adjacent either sidewall 24.

Referring now to FIGS. 1, 2, 11 and 16, the second housing 112, also comprises a housing endwall 120, a bow cover plate 122 and two sidewall members 124. Second housing 112 is similar to first housing 110, but may have different dimensions. For example, housing 112 may be shorter and may be attached to the tube rail 26 directly over the opposite endwall 20. Further, it includes several modifications due to its different functions.

The sidewall members 124, 134 of each housing 110, 112 include inner surfaces having lateral dimensions just larger than the lateral width of the tarp support frames 28 or 28'. Similarly, at least the bow cover plate 122 is shaped and dimensioned to match the shape of the mounting bow 34 or 34' and tarp retainer strip 30 or 30'. At least the second housing 112 is able to receive the lead tarp support 17 completely within the housing, so that the housing 112 provides a wind break to the tarp 14, as is described below. Wind or the elements from are thus inhibited from entering under the tarp 14 and into the container of the gondola railroad car 10.

As shown in FIGS. 11 and 16, the lead tarp support 17 may further comprise cantilevered protrusion plate 190 which extends away from the lead tarp support 17, to which the tarp 14 may be attached by appropriate fasteners 192. The cantilevered protrusion plate 190 extends the position to which tarp material 14 is attached, so that it is partially overlapped by the bow cover plate 122 immediately above the lead tarp support 17. Of course, the protrusion plate 190 must follow the shape of the corresponding bow 34 of the lead tarp support 17. To ensure that the tarp 14 is retained on the protrusion plate 190, a retainer strip 30, which is parallel to the shape of the bow 34 and protrusion plate 190, is disposed over the tarp material 14 to sandwich it between the strip 194 and the protrusion plate 190, similar to the function of the retainer strips utilized with the tarp supports 16.

So as to complete the protection from the elements, the lead tarp support 17 further includes a downwardly extending protective side plates 196 disposed at either lateral end of the lead tarp support 17. The connection of both the protrusion plates 190 and the two side plates 196 may be attached, as by welding, directly onto the bow 34 of the lead tarp support, or by other appropriate means. The side plates 196 also extend into the tarp cover housing 112, so that it is overlapped at least partially by the housing side wall members 124, when the tarp cover arrangement 12 is in its fully extended position. This arrangement provides for a reasonably complete enclosure, leaving only a slight opening between plates 124, 196 and 122, 190. To further retain the tarp cover 14 on the lead tarp support 17, the corners of the tarp material may also be attached to the side plates 196 by a fastener, such as fastener 198 shown in FIGS. 11 and 16.

Within the housings 110 are mounted the first pair of pulleys 126. The second set of pulleys 136 are mounted either within the second housing 112 or adjacent thereto. The pulleys may be mounted on each tube rail 26 immediately adjacent each of the sidewall members 124, 134. Alternatively, and preferably, the pulleys may be mounted directly adjacent the corners of the housings 110, 112, as is shown in FIGS. 11 and 12.

Figure 9:
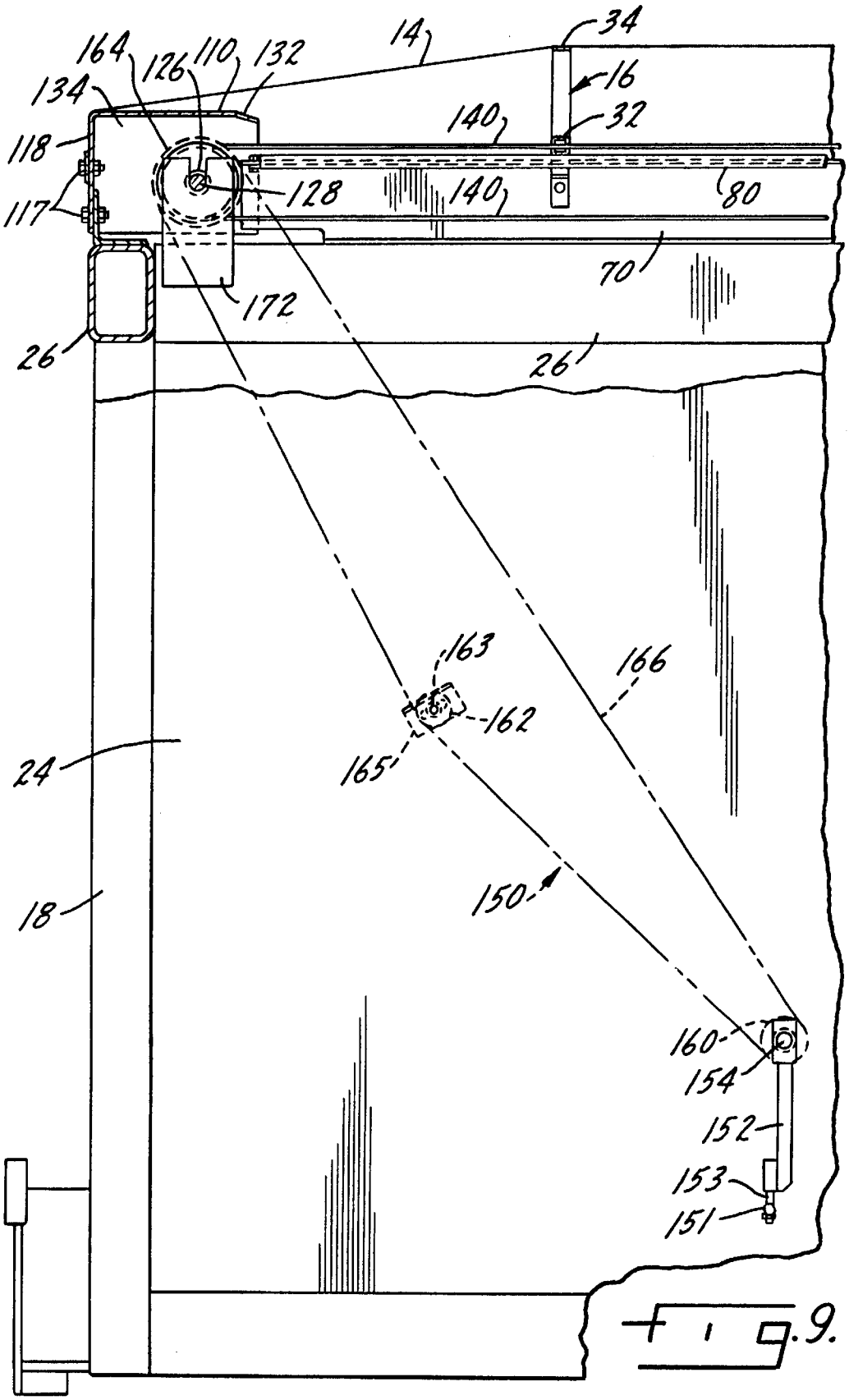
FIG. 9 is a detail, elevational view of the subassembly including the inventive tarp extending and retracting mechanism.
Figure 10:
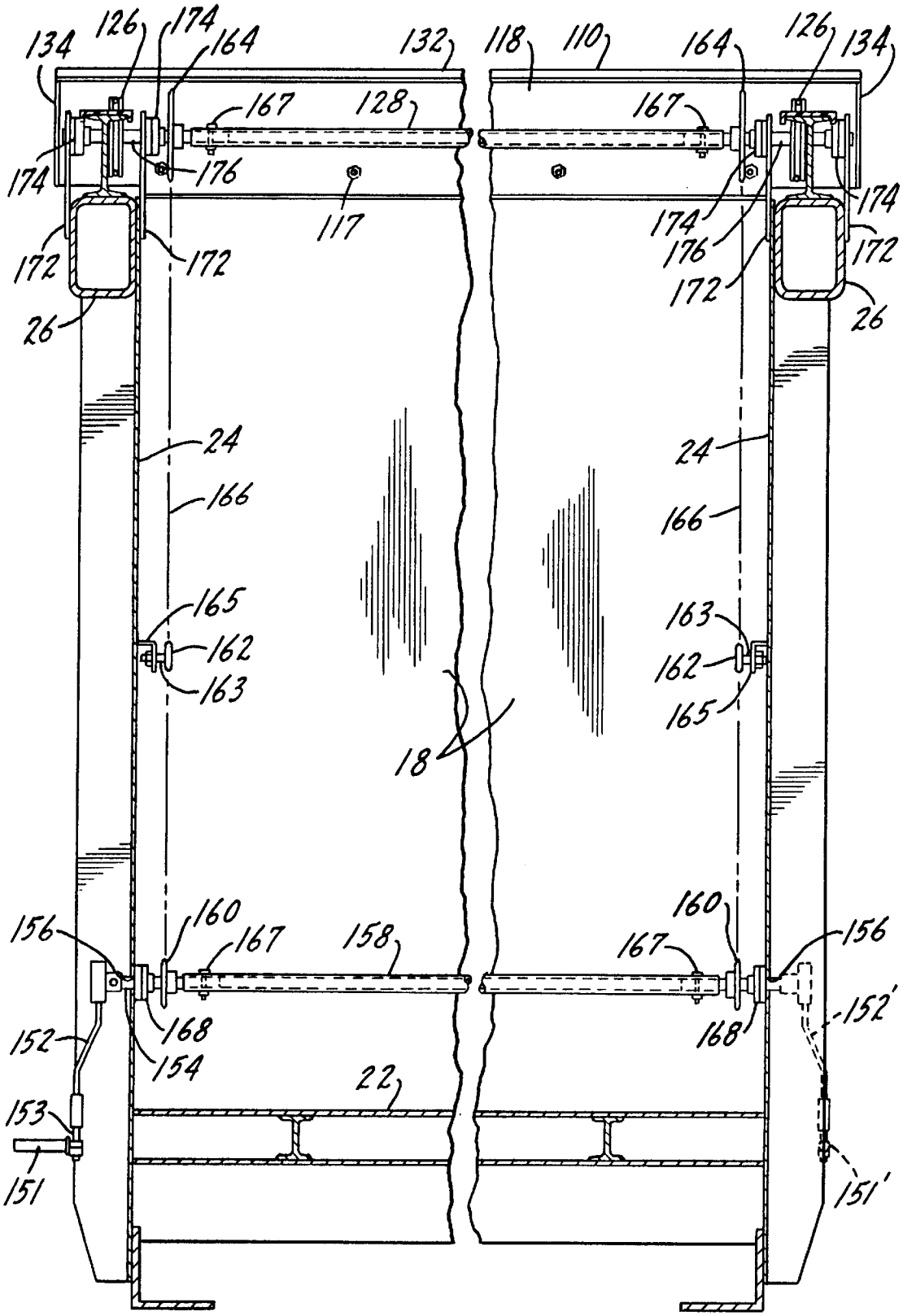
FIG. 10 is a breakaway, cross-sectional side view of the subassembly of FIG. 9, taken approximately along line 10—10 of FIG. 1.

Referring now to FIGS. 9 and 10, a cutaway end and side views of the extension and retraction drive mechanism is shown. Preferably, at least the pulleys 126 include an axle 128 which join the pulleys 126 to each other so that rotation of one pulley 126 will also rotate the other pulley 126 disposed on the opposite sidewall 24. Cables 140 extend along each runner 70 disposed on the tube rails 26 above side walls 24. One cable 140 extends in a loop about one pulley 126 and a second pulley 136 along the tube rail 26 of the top of one sidewall 24, and a second cable extends connecting second pulley 126 to second pulley 136 on the other sidewall 24. Cables 140 preferably extend above the tube rail 26, with one part of the cable loop 140 extending longitudinally above the runner upper flange 76 and the other part of cable loop 140 extending below the upper flange 76.

As described above, each of the ends of cable 140 is attached to the corresponding ends of the crossbars 32 of lead tarp support 17, by nuts and bolts or other appropriate means. Thus, transposition of the cable by rotating or turning the pulleys 126,136 causes each cable 140 to circle around the pulley loop, while simultaneously causing the cable connection and the lead tarp support 17 to move longitudinally along the runner 70. Rotation of pulleys 126 will also cause the rotation of both of pulleys 136 disposed at the opposite corners, adjacent endwall 20 of the gondola railroad car 10.

Optionally, at least one of the connections for each cable 140 includes a spring load (not shown), so that the cable is always under tension caused by the spring. Spring tension assists in simultaneous rotation of the pulleys 126, 136 when the cable 140 is being transposed.

Referring now to FIGS. 13–16, the attachment mechanism of the lead tarp support 17 to the housing 112 is described and illustrated. The lead tarp support 17 further comprises an attachment member, such as a catch 146, centrally disposed as shown or adjacent to an outwardly facing wall 31 of the crossbar 32 or 32'. A corresponding hook 148 is centrally disposed on the endwall 120 of the housing 112, which pivots about a pivot pin 150 that preferably is in or parallel to the plane of the endwall 20. The hook 148 itself may be manually controlled by a lever 102 which extends through housing end wall by means of an aperture 119. The end of lever 102 including the hook 148 extends into the gondola car container.

The opposite end of lever 102 extend outwardly from the aperture 119 in endwall 120. The opposite end of lever 102 is attached to an elongated extension 106 which extends vertically downward from the lever 102 toward the ground. One or more guides 107 provide channels for supporting the elongated extension 106 adjacent wall 20, while permitting vertical motion of the extension. The opposite end closest to the ground of extension 106 is attached to a handle 104 or, as shown, handle 104 is integral with the extension 106. Handle 104 is within easy reach of an operator who may be standing on the ground. A handle retainer 108 at about the level of the railroad car floor is attached to endwall 20 to enable retention of the handle 104 and thereby lever 102 at a desired position.

The function of hook 148 is to latch onto the catch 146 and to retain the lead tarp support 17 and longitudinal end of tarp cover 14 enclosed within the housing 112. The latched position of hook 148 causes the lead tarp support 17 to be releasably attached within the housing 112 covering the opening between the tarp 14 and the tube rail 26 atop the endwall 20. The configuration of the covering provided by housing 112 over the end of tarp 14 connected to the lead support 17 and protrusion plates 190, 196 inhibits wind or the elements from entering through the slight opening between the tarp cover 14 and tube rail 26.

In a preferred configuration, the protrusion plates 190, 196 are long enough that the plane of the lead edges approaches the edge of the wall surface of the cover endwall 120. A gap between the edges of protrusion plates 190, 196 and cover endwall 120 may not be eliminated, but an airtight seal of the gondola car container is not necessary. The bow cover plate 122 of tarp support housing 120 should be wide enough in the longitudinal direction to overlap the protrusion plates 190, 196 and thereby inhibit the major part of wind and elements from entering into the gondola railroad car container. The conjunction of the lead tarp support 17 and housing 112, when the tarp is fully extended as illustrated in FIGS. 11 and 16, produces an adequate arrangement which enables the contents of the gondola railroad car to be protected, even though a complete water or airtight seal is not provided.

This type of configuration also may be used at the opposite housing 110, so that the opposite longitudinal end of tarp cover 14 is also covering the housing 110. Preferably, as shown in FIG. 9, the opposite longitudinal end of tarp 14 is attached directly to the bow cover plate 132 and/or to endwall 118 of housing 110. The attachment may be made directly onto the stationary housing 110, rather than to a tarp support 16, since that extreme longitudinal end of tarp cover 14 connected to endwall 118 remains stationary and is not transposed during operation of the tarp cover arrangement 12. Such a connection may be made by nuts and bolts fasteners 117 inserted through appropriate apertures in the longitudinal end of tarp 14, as is shown in FIG. 9. Optionally, as shown in FIG. 3, the longitudinal end of tarp 14 is retained by a retainer strip 119, as shown in FIG. 3.

Other connection mechanisms are also possible, for example, by riveting or gluing the end of the tarp 14 to the mounting bow cover 132 or endwall 118 of housing 110. Another and preferred alternative is to capture the longitudinal end of tarp 14 between a cover plate and a laterally extending retainer strip 119 (FIG. 3) and an appropriate attachment, such as nut/bolt combination 117, for joining the cover plate 132 to the strip 119 in a way that retains the captured end of the tarp material and attaches the tarp material between them.

It is not altogether necessary that the cover plate 132 of housing 110 be shaped and dimensioned and have an exactly matching profile to exactly receive the mounting bows 34 of the tarp supports 16, since the alternate methods of retaining the tarp abutment against the tube rail 26 of endwall 18 provides for a junction that inhibits entry of the elements or of wind into the gondola railroad car container. As long as all the tarp cover 14 and tarp supports 16 can be retracted to a position close to the housing 110, thereby permitting access to the floor 22 of the gondola railroad car, it is not of important that the tarp supports 16 always be stowed under the housing 110 during the loading/unloading operation. As shown in FIG. 9, the preferred method is to have the housing 110 be shorter than the height of the bows 34 so that the tarp 14 is at a slight angle as it becomes taut during the extension of the tarp arrangement 12. This angular deviation permits water to roll off of the tarp cover 14.

Any of the alternatives described above for abutting the tarp 14 to the gondola railroad car tube rail 26 or end wall 20 gives the configuration the capability for high speed transport of the gondola railroad car 10 in either forward or rearward directions. That is, the gondola railroad car container should be protected from the elements and from wind irrespective of the direction of travel of the gondola car during train transport.

As can be appreciated by those having ordinary skill in the art, the movement or transposition of the lead tarp support 17 from a fully extended position, i.e., when abutting the housing 112, to a retracted position, in which the lead tarp support 17 of cover arrangement 12 is retracted toward the other housing 110, is basically accomplished by rotation of the pulleys 126, 136. The driving force to rotate the pulleys 126 preferably will be enabled by manual operation of trained personnel present at the gondola car loading and unloading stations. The difficulty in providing a power source to a long train of railroad cars in the field, which would enable automated rotation of the pulleys, may be appreciated.

It is considered an alternative that an automated power source may be optionally added to the present invention as an additional feature to extend and retract the tarp cover 14 more easily and efficiently. Such an automated power source may comprise a portable pneumatic or electric motor (not shown) that could be directly or indirectly connected to the pulleys 126, or to the axle 128, joining the pulleys 126 together.

The preferred manual method of rotating pulleys 126 is through a hand-cranked sprocket wheel and chain mechanism 150, as shown in FIG. 1 and in greater detail in FIGS. 9 and 10. A crank handle 152 including a rotating handle attachment 151, is mounted on a crankshaft 154 extending through a handle aperture 156 bored through one or both sidewalls 24 of the gondola railroad car 10. The crankshaft 154 is preferably connected to an axle 158 which extends across the width of the gondola car 10, as shown in FIG. 10. Each of the sidewalls 24 may include a laterally extending handle aperture 156, through which each end of the crankshaft 154 and axle 158 extend.

Referring now to FIGS. 9 and 10, the crank handle is shown in phantom in a secondary position on the opposite wall 24, as indicated by the identification numeral 152'. When the crank handle 152 is being used to rotate axle 158, the handle attachment 151 extends outwardly from the sidewall 24 as shown, so that an operator may conveniently turn the crank handle 152. However, because of side to side dimension limitations and regulations established for railroad cars, and for safety considerations, it is important that the handle attachment 151 be stowed so that it does not protrude beyond the outer shell dimension of sidewall 24 during the transport. Thus, and as shown in FIG. 10, the handle attachment 151 pivots about an axle 153 at its connection point to crankshaft handle 152 so that it may be rotated to a position parallel to the sidewall 24. The handle attachment forward position is shown in phantom in FIG. 10 by the crankshaft handle attachment 151'. Stowing the handle attachment 151' in this position is necessary during transport of the gondola car 10, in order to comply with railroad transport regulations.

The axle 158 preferably, includes lower sprocket wheels 160, one adjacent each sidewall 24. Together with an intermediate pulley sprocket wheels 162, upper sprocket wheels 164 and a connecting chain 166. Lower sprocket wheels 160 can drive the pulleys 126 when the crankshaft 154 is rotated.

If the crankshaft 154 is disposed close to the floor 22 of the gondola railroad car 10, then the crank handle 152 may be cranked by a person of normal height from either side of the gondola railroad car 10. Moreover, by making the crank handle 152 detachable from the crankshaft 154 by means of collet pins, lock pins or other appropriate attachments, the handle 152 may be utilized for tarp extension/retraction on either side of the railroad car 10 simply by removing the handle 152 from one side of the railroad car and attaching it to the crankshaft 154 disposed on the opposite sidewall 24, as shown in phantom in FIG. 10.

To enable easier rotation of the crankshaft 154 and axle 158 combination, the axle 158 may be mounted within the aperture 156 by means of a bearing or roller bearing 168, as shown in FIG. 10. Preferably, the crankshaft 154 extends through the aperture 156, and is supported on the sidewall 24 by the bearing 168. Laterally inwardly of the bearing 168, the crankshaft 154 is connected to the axle 158 by means of a collet pins 167 or other appropriate connection means. Of course, for a system configuration in which a crankshaft 154 extends through an aperture 156 on the opposite sidewall 24, the same configuration may be utilized for mounting the opposite end of the axle 158 to the opposite sidewall.

In an alternative configuration, a separate aperture 158 on the opposite sidewall is unnecessary if a crankshaft 154 is not needed for crankshaft rotation from the opposite wall 24. A configuration in which a crankshaft may be turned only on one side of the gondola car 10 may be utilized so as to not require puncturing a second aperture in the gondola walls or from a desire to reduce the installation costs of the system. Such an alternative configuration would require a mounting mechanism for the axle 156 on the opposite sidewall 24. An appropriate mechanism may be a bearing (not shown), similar to bearing 168, which is welded or otherwise affixed onto the opposite sidewall 24, so that the axle 156 and sprocket may be positioned appropriately to permit a second sprocket wheel and chain assembly to operate a pulley 126 disposed adjacent the rail 26 of the opposite sidewall.

Two sets of pulleys 126 and two mechanisms 150 for extending the tarp 14 are preferable, one mounted atop either sidewall 24. Two sets of mechanisms 150, one associated with either sidewall 24, are needed to produce equal lateral forces for pulling the lead tarp support 17 and for maintaining the perpendicular relationship for all the tube rails 26. Also, two identical sets of sprocket wheels 126, 160, 162 arranged adjacent each sidewall 24 permit the extending and retracting process to proceed evenly when the crankshaft 154 is rotated.

Between the upper opposite corners of the gondola car 10, adjacent the tube rails 26, the second upper axle 128 extends between the upper sprocket wheels 164 as shown in FIG. 10. The upper sprocket wheels 164 are connected to the axle 128 by collet pins 167 or other appropriate means. Either the axle 128, or an extension shaft 176 connected to the axle 128, extend to the pulleys 126, as shown.

Preferably, the tarp cover arrangement 12 is provided in the form of a kit, which comes preassembled and is connected prior to the final installation onto a gondola car 10. Preferably, installation of the arrangement on a gondola car would require the welding of the runner 70 on to the tube rails 26, without the necessity of producing adjustment mechanisms or other orientation members to the arrangement 12.

Referring now to FIGS. 11 and 12, illustrated in greater detail is the structure of pulleys 136 and the preferred attachment of the pulleys 136 to the tarp cover arrangement 12. Pulleys 136 are mounted onto bracket places 182, which themselves are mounted directly onto the tarp support housing 112. A section 113 may engage an end of each runner 70 by means of engagement plate 115, disposed between tube rail 26 and the runner 70.

Bracket assembly 180 preferably comprises a bracket mounting plate 182 for attachment to the housing 112 and a mounting bolt/nut fastener 184, which engages the bracket mounting plate 182 and attaches the pulley 136 to the mounting plate 182. For ease in rotation of pulley 136, it is desirable that the pulley engages the mounting plate 182 through a set of bearings 186 on either side of the pulley 136.

As shown in FIG. 12, each pulley 136 is independently mounted on the tarp support housing 112. Pulleys 126 (FIG.

10) require an axle 128 connecting them so that they rotate simultaneously. Unlike the connection of pulleys 126, the pulleys 136 (FIG. 12) mounted adjacent endwall 20 do not require simultaneous rotation of the pulleys 136; thus no corresponding axle is shown in FIG. 12. However, since the assembly being driven by the operator will rotate both pulleys 126 simultaneously, and the cables 140 would also rotate pulleys 136, it is possibly desirable to also include an axle (not shown) so that all four pulleys 126, 136 are rotated simultaneously.

In keeping with the preferred embodiment of the arrangement 12 in kit form, the end bracket 180 for pulley 126 is welded or otherwise permanently attached directly onto the section 113 which is supported by the tube rail 26 and engages the runner 70 and tarp support housing 112. Thus, the housings 110 and 112 may be assembled by inserting the engagement plate 115 within slots on either side of each runner 70, and by welding or otherwise connecting the housing and bracket assembly 180 to the tube rail 26.

Similarly, housing 110 may also be attached as an assembly to the tube rail 26 atop endwall 18. Care must be taken in assembly to ensure that through bores 156 for receiving the axle 128 are essentially parallel to the end wall 18. To ensure a greater possibility of success in achieving proper orientation of bores 156, it is important that the ends of runner 70 are square and that the bracket mounting plates 182 are identical to each other and are correctly attached to housing 112.

Alternatively, the pulleys 126, 136 may be mounted directly upon the ends of runner 70 by welding one or more bracket assemblies 180 to the runner 70, before the runner 70 is attached to the tube rail 26. In this configuration, the tarp support housings 110, 112 would be attached to the tube rail 26 after the runners 70 are connected.

Returning now to FIGS. 9 and 10, pulleys 126 may be essentially enclosed within a pulley housing 110, and providing a mount for the pulleys 126 and for mounting of the axle 128. The pulley housing 110 may be attached to the tube rail 26, as shown in this embodiment. The housing 110 has two sidewalls, and includes bracket plates 172 at either side of pulley 126 through which the end of axle 128 extends into the enclosure of the pulley 126. The mounting arrangement provides free rotatability of the axle 128, and one or more bearings 174 reduce the friction of rotation of the axle 128.

Pulley 126 is attached to the end of axle 128, so that the pulley 126, the axle 128 and the sprocket wheel 164 all rotate together. Bearings 174 may be attached to the bracket 172 by welding or other means at a position adjacent the bore through which the axle 128 extends, to more readily permit rotation of the axle 128, similar to the bearing mounts 168 of the lower axle 158.

The sprocket wheels 160, 162, 164 operate jointly because they are connected to each other through chain 166, which is looped in an endless loop between sprocket wheels 160, 164. Because the length of the chain 166 may extend to well over 15 feet, the chain loop would sag and possibly provide a loose connection to the sprockets. To keep the chain 166 taut, an intermediate sprocket wheel 162 is eccentrically disposed at some lateral distance from the straight line connection between the sprocket wheels 160, 164. As is shown in FIG. 9, the offset dimensions of sprocket wheel 162 is on the order of about one foot, and is sufficient to maintain the chain loop tight to prevent the chain 16 from slipping over the sprockets of sprocket wheels 160, 162, 164.

Intermediate sprocket wheel 162 is attached to a spindle 163 which is preferably welded on to a block 165 that is itself welded against the sidewall 24. The block 165 has a dimension which positions the sprocket wheel 162 within the plane defined by the chain loop of chain 166. The configuration described provides for the endless cycle, and the plane of the chain loop is spaced so it is parallel, to but spaced from, the sidewall 24 to maintain a minimum distance between the chain 166 and the sidewall 24 of the gondola car 10. The intermediate sprocket wheel 162 rotates around spindle 163, which is preferably disposed perpendicularly to the wall 24.

As the sprocket wheels 160 at either end of axle 158 are rotated by the crankshaft 154, the sprockets drive the chain loops 166 on both sidewalls 24 of the gondola car, so that the chain 166 drives the sprocket wheels 164 and simultaneously rotates the axle 128. As the axle 128 rotates, the axle also rotates the pulleys 126 on both ends of the tarp support housing 110, which axle rotation also turns the loops of cables 140 extending above each of rails 26 atop the longitudinal sidewalls 24. As described above, the advance of cables 140 in a loop also rotates the pulley 136 at the other end of the gondola railroad car.

As is described above, the cable loops 140 each extend essentially the complete length of the gondola railroad car 10. Cables 140, one each on opposite sidewalls 24 of gondola railroad car 10, are looped around both pulleys 126, 136. The two ends of the cable 140 are each attached to the lead bow 17, as described above.

Appropriate vertical positioning of a mounting bracket assembly 180 on the end of runner 70, in conjunction with selection of pulleys 126, 136 of appropriate size, permits cable 140 to loop about pulley 126, as shown in FIG. 9, and for the two longitudinally extending sections of cable 140 to extend one above and one below the upper flange 76 of runner 70. Because of the tolerances in the length of the loop of cable 140, and the ability to adjust the length at the connection point at the lead tarp support 17, described above, the cable loop is maintained taut, and rotation of pulley 126 causes the longitudinal transposition of the cable 140, the lead tarp support 17 and a corresponding rotation of the pulleys 136 that are disposed on the opposite end wall 20.

Rotation of pulleys 126, 136 by the drive mechanism 150 causes the cable 140 to pull the lead bow 17 in a parallel direction along the runners 70, so as to either extend or retract the tarp 14 attached to the lead support bow 17. As the tarp material becomes extended, the tarp pulls additional bow supports 16 along the runner 70 until all the supports 16 have been deployed, and the lead bow support 17 has extended completely and reached within the tarp support housing 112 in which pulleys 136 are housed. The lead tarp support may then be locked in place by the locking mechanism shown in FIGS. 13–16.

In retracting the tarp 14, the crankshaft 154 is rotated in the opposite direction, thus causing the rotation of axle 128 in a direction opposite to that of the deployment of the tarp 14. The pulleys 126, 136 rotate in the opposite direction, thereby causing the cable 140 to pull the cable ends 140' or 140" and the lead bow support 17 in the direction from the first housing 112 toward the second housing 110. As the lead tarp support 17 is transposed along the runner 70, it engages the tarp supports 16 which have been spaced apart along the runner 70 during deployment. As the supports 17 and 16 engage successive supports 16, the tarp material 14 becomes pleated between them, in an accordion style, thereby compacting the tarp material and enabling it to be temporarily stowed adjacent the second housing 110, while permitting free access to the floor 22 and the inside of gondola car 10.

Referring now to FIGS. 5 and 6, herein is described the retention of the proper orientation of the tarps 16 during the retraction and extension of the tarp 14. The cable 140 extends through each of the apertures 46 at either lateral end of the crossbar 32. The apertures 46, and for the alternative embodiment FIGS. 7 and 8, apertures 46', are each of a size just slightly larger than the predetermined diameter of cable 140. The slightly larger size of the aperture 46 permits the cable to be inserted through each of the crossbars 32 during the installation of the tarp cover arrangement. While the cable 140 extends through the apertures 46, the relative sizes do not create any blockage so that the cable 140 may be pulled through the aperture without binding or otherwise shifting the position of the tarp supports 16.

The taut condition of the cable 140 further aids in maintaining the orientation of the tarp supports 16 because of the width of the crossbar 32 provides two spaced contact points to the cable 140, thus retaining the apertures 46 in line with the cable 140. This feature also permits the cable to lineup the tarp support 16 when the tarp is retracted toward the housing 110. During the retraction operation, the turning of crank handle 152 causes the lead tarp 17 to be pulled by cable 140 toward the housing 110. As the cable 140 pulls the lead tarp 17, it is pulled through the apertures 46 of all of the tarp supports 16 between the lead tarp support 17 and the housing 110. The lead tarp support is transposed along the runner 70 until it engages the next adjacent tarp support 16, which is lined up by the cable 140 and apertures 46 to be parallel to and in line with the lead tarp support 17. Continued rotation of the cable 140 will also engage the succeeding tarp support 16, one by one, forced by the cable 140 to line up with each other, until all of the tarp supports 16 are bunched together adjacent the housing 110, leaving the gondola car container open for the loading or unloading procedure.

Referring again to FIGS. 9 and 10, the mounting arrangement of pulleys 126 within housing 110 is described. Housing 110 is attached to the tube rail 26 atop endwall 18 by welding or other permanent attachment. The pulley 126 is itself at least partially contained within an enclosure defined by the bracket assembly of brackets 177, the purpose of which is to maintain the pulley 126 free and clear of obstructions which may obstruct proper operation of the pulley 126 in the rotation relationship with the cable 140 (FIG. 10). Pulley mounting bracket 172 also provide a more secure mounting arrangement for pulley 126 and axle 128.

While the above description and illustrations are considered to provide examples of the features considered to be inventive by the inventor, the configurations illustrated and described are not to be considered limiting of the full scope of the invention, which is only limited by the following claims and their equivalents.

What is claimed is:

1. A flexible sheet gondola railroad car cover for covering the open top of a gondola railroad car, the gondola railroad car having at least two sidewalls, comprising:

a) at least one runner extending along the top of each of the sidewalls of the gondola railroad car, each said runner further having an upper surface covered by a friction reducing elastomeric material defining a smooth slidable surface extending along and essentially parallel to an associated top of the gondola railroad car sidewalls;

b) a flexible sheet cover being wide enough to extend laterally for a dimension at least as wide as the area between the sidewalls of the gondola railroad car;

c) a plurality of cover supports attached to the cover in spaced apart relation and slidable on said smooth slidable surface of each of said runners.

2. The car cover according to claim 1 wherein said runners attach to the top of each sidewall of the gondola railroad car and each said cover support includes a frame member comprising a crossbar having a flat surface adjacent each end thereof in sliding relation to said smooth slidable surfaces of said runners, a mounting bow connected at its ends to the ends of said crossbar, said mounting bows being convexly bent above said crossbars and sloping upwardly from the connections at the ends of said bows and crossbars to the midpoint of said bow.

3. The car cover according to claim 2 further including an elongated, slidable sleeve extending the length of each said runner, said sleeve covering said runner upper surface and providing said smooth slidable surface for permitting longitudinal translation of said cover supports.

4. The cover according to claim 3 wherein said sleeve comprises a hard, moldable, elastomeric material.

5. The cover according to claim 4 wherein said sleeve is unitary and said hard, moldable elastomeric material comprises polyurethane.

6. The car cover according to claim 1 further including an elongated sleeve extending the length of each said runner, said sleeve covering said runner upper surface and providing said smooth slidable surface, a vertically sliding surface and a downwardly facing third sliding surface wherein each said cover support includes a downwardly extending slat extension at each end thereof and a cantilevered runner retainer extending inwardly from each said slat extension, said cover being attached to said slat extensions, said slat extensions being disposed for sliding engagement with said vertical sliding surface and said cantilevered runner retainers being disposed for sliding engagement with said downwardly facing third sliding surface.

7. The cover according to claim 6 wherein said sleeve comprises a hard, moldable, elastomeric material and each said cover support includes a frame member comprising a crossbar having a flat surface adjacent each end thereof in sliding relation to said smooth slidable surfaces of said runners, a mounting bow connected at its ends to the ends of said crossbar, said mounting bows being convexly bent above said crossbars and sloping upwardly from the connections at the ends of said bows and crossbars to the midpoint of said bow.

8. The cover according to claim 7 wherein said sleeve is unitary and said hard, moldable elastomeric material comprises polyurethane and said slat extensions each include a rounded guide extending between said crossbar and said retainer member for sliding engagement with said vertical sliding surface of said sleeve.

9. A kit for retrofit installation atop a gondola railroad car for covering an open top of the railroad car, said kit comprising:

a) at least one runner for extending along the top of each of the sidewalls of the gondola railroad car, each said runner further having an upper surface covered by a friction reducing elastomeric material defining a smooth slidable surface for extending along and essentially parallel to an associated top of the gondola railroad car sidewalls;

b) a flexible sheet cover being wide enough to extend laterally for a dimension at least as wide as the intended area between the sidewalls of the gondola railroad car;

c) a plurality of cover supports, attached to the cover in spaced apart relation and slidable on said smooth slidable surface of each of said runners.

10. The kit according to claim 9 wherein said runners attach to the top of each sidewall of the gondola railroad car and each said cover support includes a frame member comprising a crossbar having a flat surface adjacent each end thereof in sliding relation to said smooth slidable surfaces of said runners, a mounting bow connected at its ends to the ends of said crossbar, said mounting bows being convexly bent above said crossbars and sloping upwardly from the connections at the ends of said bows and crossbars to the midpoint of said bow.

11. The kit according to claim 10 further including an elongated sleeve extending the length of each said runner, said sleeve covering said runner upper surface and providing said smooth slidable surface for permitting longitudinal translation of said cover supports.

12. The kit according to claim 11 wherein said sleeve comprises a hard, moldable, elastomeric material.

13. The kit according to claim 12 wherein said sleeve is unitary and said hard, moldable elastomeric material comprises polyurethane.

14. The kit according to claim 9 further including an elongated sleeve extending the length of each said runner, said sleeve covering said runner upper surface and providing said smooth slidable surface, a vertical sliding surface and a downwardly facing third sliding surface wherein each said cover support includes a downwardly extending slat extension at each end thereof and a cantilevered runner retainer extending inwardly from each said slat extension, said cover being attached to said slat extensions, said slat extensions being disposed for sliding engagement with said vertical sliding surface and said cantilevered runner retainers being disposed for sliding engagement with said downwardly facing third sliding surface.

15. The kit according to claim 14 wherein said sleeve comprises a hard, moldable, elastomeric material and each said cover support includes a frame member comprising a crossbar having a flat surface adjacent each end thereof in sliding relation to said smooth slidable surfaces of said runners, a mounting bow connected at its ends to the ends of said crossbar, said mounting bows being convexly bent above said crossbars and sloping upwardly from the connections at the ends of said bows and crossbars to the midpoint of said bow.

16. The kit according to claim 15 wherein said sleeve is unitary and said hard, moldable elastomeric material comprises polyurethane and said slat extensions each include a rounded guide extending between said crossbar and said retainer member for sliding engagement with said vertical sliding surface of said sleeve.

17. A flexible sheet gondola railroad car cover for covering the open top of a gondola railroad car, the gondola railroad car having at least two sidewalls, comprising:

a) at least one runner extending along the top of each of the sidewalls of the gondola railroad car, each said runner further having an upper surface covered by a friction reducing elastomeric material defining a smooth slidable surface extending along and essentially parallel to an associated top of the gondola railroad car sidewalls;

b) an elongated sleeve extending the length of each said runner, said sleeve covering said runner upper surface and providing said smooth slidable surface and a vertical sliding surface;

c) a flexible sheet cover being wide enough to extend laterally for a dimension larger than the distance between the sidewalls of the gondola railroad car and long enough to cover the open top of the gondola car, said cover being extendable to cover said open top of said gondola car and retractable to provide access to said gondola car through said open top;

d) a plurality of cover supports attached to the cover in spaced apart relation and slidable on said smooth slidable surface of each of said runners, and each said cover support including a frame member comprising a crossbar having a flat surface adjacent each end thereof in sliding relation to said smooth slidable surfaces of said runners, a mounting bow connected at its ends to the ends of said crossbar, said mounting bows being convexly bent above said crossbars and sloping upwardly from the connections at the ends of said bows and crossbars to the midpoint of said bow, wherein each said cover support includes a downwardly extending slat extension at each end thereof and a cantilevered runner retainer extending inwardly from each said slat extension, said cover being attached to said slat extensions, said slat extensions being disposed for sliding engagement with said vertical sliding surface.

18. The cover according to claim 17 wherein said sleeve comprises a hard, moldable, elastomeric material and wherein said cover supports are attached to said flexible sheet cover at a spacing of about two feet apart.

19. The cover according to claim 18 wherein said hard, moldable elastomeric material comprises polyurethane and said slat extensions each include a rounded guide extending between said crossbar and said retainer member for sliding engagement with said vertical sliding surface of said sleeve.

20. A flexible sheet gondola railroad car cover for covering the open top of a gondola railroad car having at least two sidewalls, comprising:

a) at least one runner extending along the top of each of the sidewalls of the gondola railroad car;

b) a flexible sheet cover being wide enough to extend laterally for a dimension at least as wide as the area between the sidewalls of the gondola railroad car;

c) a plurality of cover supports attached to the cover in spaced apart relation, each said cover support including a frame member comprising a crossbar having a flat surface adjacent each end thereof in sliding relation to said runner, a mounting bow connected at its ends to the ends of said crossbar, said mounting bows being convexly bent above said crossbars and sloping upwardly from the connections at the ends of said bows and crossbars to the midpoint of said bow.

* * * * *